US005142464A

United States Patent [19]

Wang

[11] Patent Number: 5,142,464

[45] Date of Patent: Aug. 25, 1992

[54] MOUNTING ASSEMBLY FOR THE ROTARY DIMMER SWITCH OF A FLOOR LAMP

[76] Inventor: Gary Wang, 2F, No. 3, Lane 73, Hsin Hai Rd., Sec. 5, Taipei, Taiwan

[21] Appl. No.: 727,440

[22] Filed: Jul. 9, 1991

[51] Int. Cl.[5] ..... F21S 1/12

[52] U.S. Cl. ..... 362/295; 362/411; 362/457

[58] Field of Search ..... 362/394, 410, 411, 413, 362/414, 418, 431, 285, 205, 457, 458; 285/907

[56] References Cited

U.S. PATENT DOCUMENTS

| | | | |
|---|---|---|---|
| 1,582,005 | 4/1926 | Gross | 362/295 |
| 2,144,197 | 1/1939 | Nirdlinger | 285/907 |
| 2,491,448 | 12/1949 | Hillenbrand et al. | 362/295 |
| 3,609,347 | 9/1971 | Kopenhaver | 362/295 |
| 3,800,136 | 3/1974 | Edelson | 362/157 |
| 4,843,526 | 6/1989 | Price, III | 362/205 |
| 5,016,154 | 5/1991 | Leeyeh | 362/414 |

FOREIGN PATENT DOCUMENTS

| | | | |
|---|---|---|---|
| 545913 | 9/1957 | Canada | 362/411 |

*Primary Examiner*—Richard R. Cole
*Attorney, Agent, or Firm*—Bacon & Thomas

[57] ABSTRACT

A rotary dimmer switch mounting structure for a floor lamp, comprising two tubes connected by a pipe connector and fastened in a floor to support a lamp, and a rotary dimmer switch received inside the pipe connector and the tubes and controlled by a revolving shaft to regulate the intensity of light produced by the lamp, wherein the pipe connector has an elongated slot longitudinally extending from either end edge thereof for receiving the rotatable control shaft and therefore, the diameter of the tubes can be smaller than the total height of the shaft.

1 Claim, 4 Drawing Sheets

MOUNTING ASSEMBLY FOR THE ROTARY DIMMER SWITCH OF A FLOOR LAMP

BACKGROUND OF THE INVENTION

The present invention relates to a floor lamp rotary dimmer switch mounting structure and relates more particularly to a tubular lamp support for a floor lamp which has means to receive a rotary dimmer switch therein so that the design of the diameter of the tubular lamp support is free from the restriction of the total height of the revolving shaft of the rotary dimmer switch.

In regular floor lamps, a rotary dimmer switch is generally fastened inside the lamp support thereof and controlled by a rotatable control shaft to regulate a variable resistor so as to change the intensity of light. The lamp support is generally made of tube or tubes. The tube or either of the tubes has a round hole for inserting the revolving haft of the rotary dimmer switch. Because the rotatable control shaft is fixedly fastened in the variable resistor, the diameter of the tube or tubes B must be wider than the total height A of the variable resistor and the revolving shaft so that the rotary dimmer switch can be fastened inside the tube or tubes. If thinner a lamp support is used for making a floor lamp, the rotary dimmer switch must be changed to a foot dimmer switch which secures outside the tube.

SUMMARY OF THE INVENTION

The present invention has been accomplished to eliminate the aforesaid problems. According to the present invention, there is provided a a floor lamp rotary dimmer switch mounting structure which uses a coupling to connect two tubes together, which coupling has an elongated slot longitudinally extending from either end edge thereof for receiving the revolving shaft of the rotary dimmer switch which is received inside the tubes. Because of the design of the elongated slot on the pipe connector, the diameter of the tubes can be smaller than the total height of the variable resistor and the rotatable control shaft of the rotary dimmer.

DETAILED DESCRIPTION OF THE PREFERRED EMBODIMENT

Figure 1:
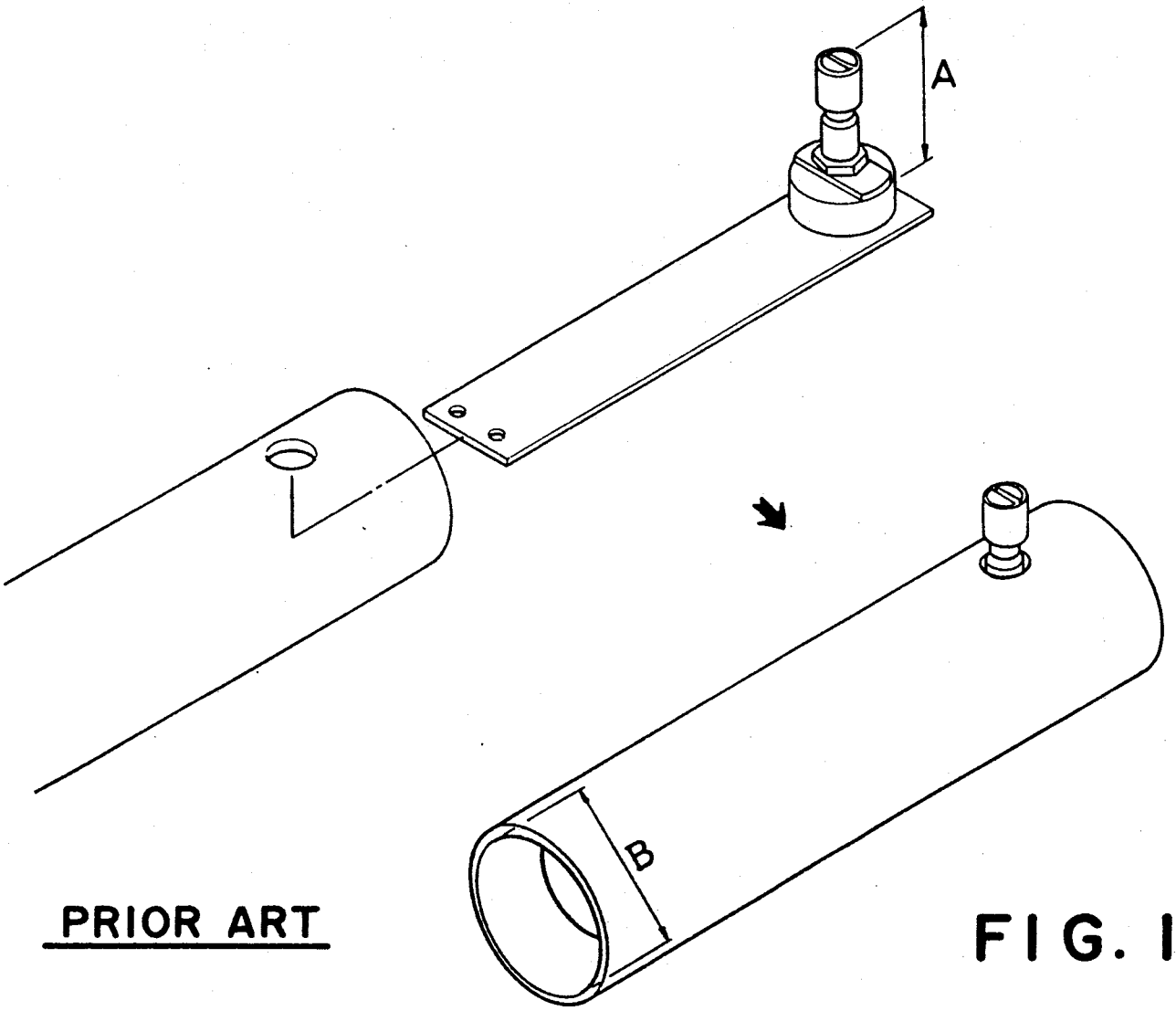
FIG. 1 PRIOR ART
FIG. 1 illustrates a floor lamp rotary dimmer switch mounting structure according to the prior art.
Figure 2:
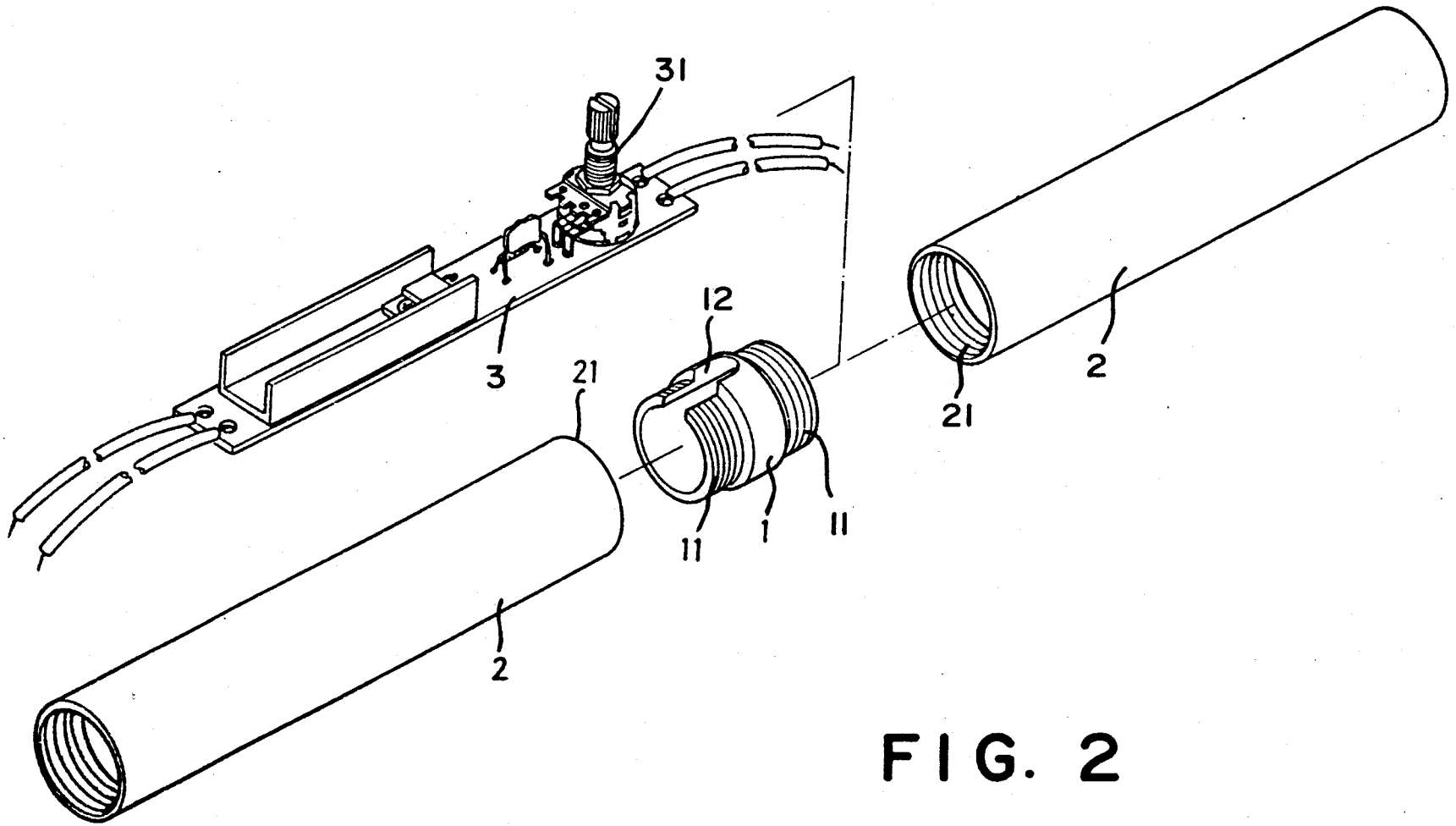
FIG. 2 is an exploded perspective view of a floor lamp rotary dimmer switch mounting structure as constructed in accordance with the present invention.
Figure 3:
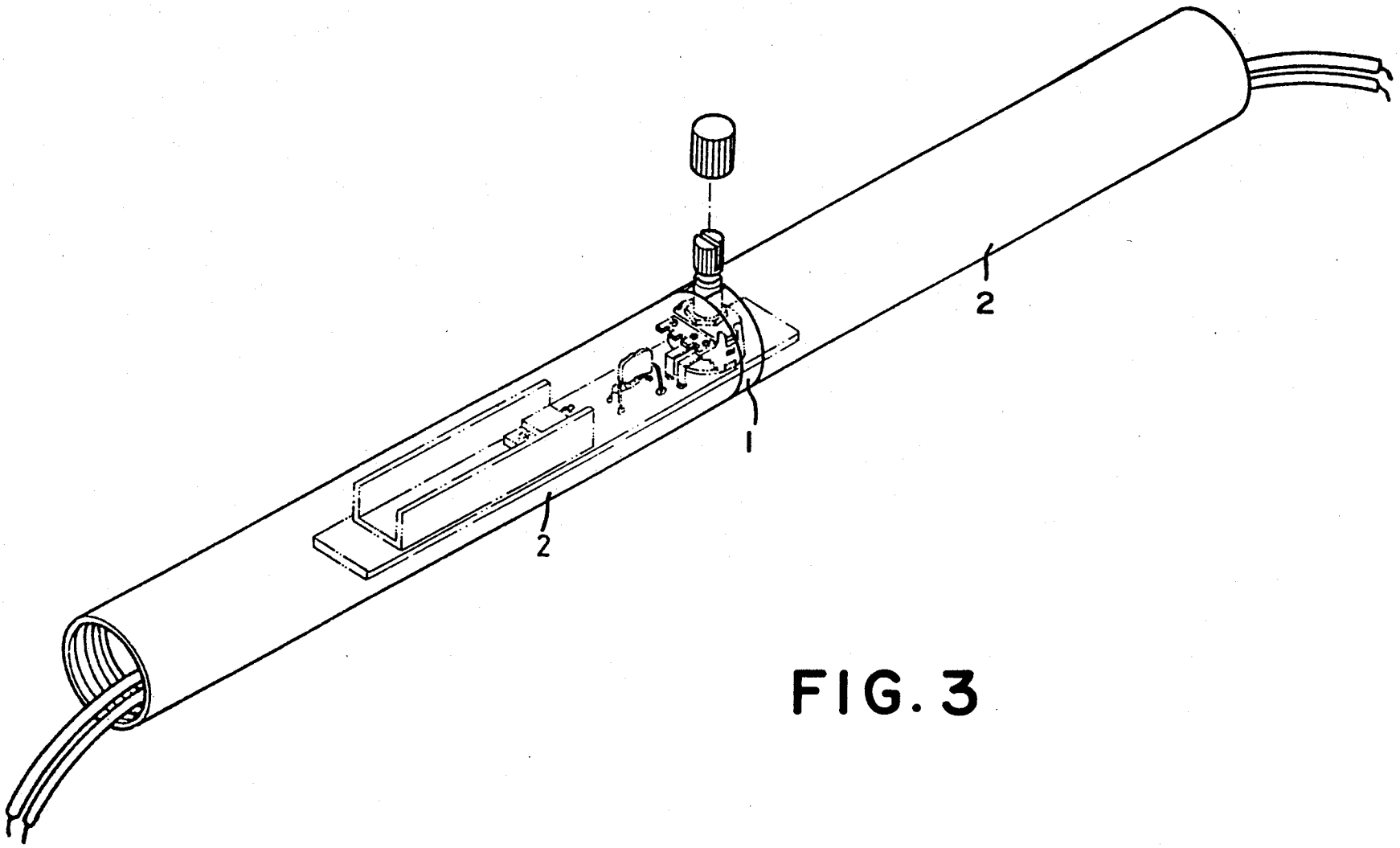
FIG. 3 is a perspective assembly view of the floor lamp rotary dimmer switch mounting structure of FIG. 2.
Figure 4:
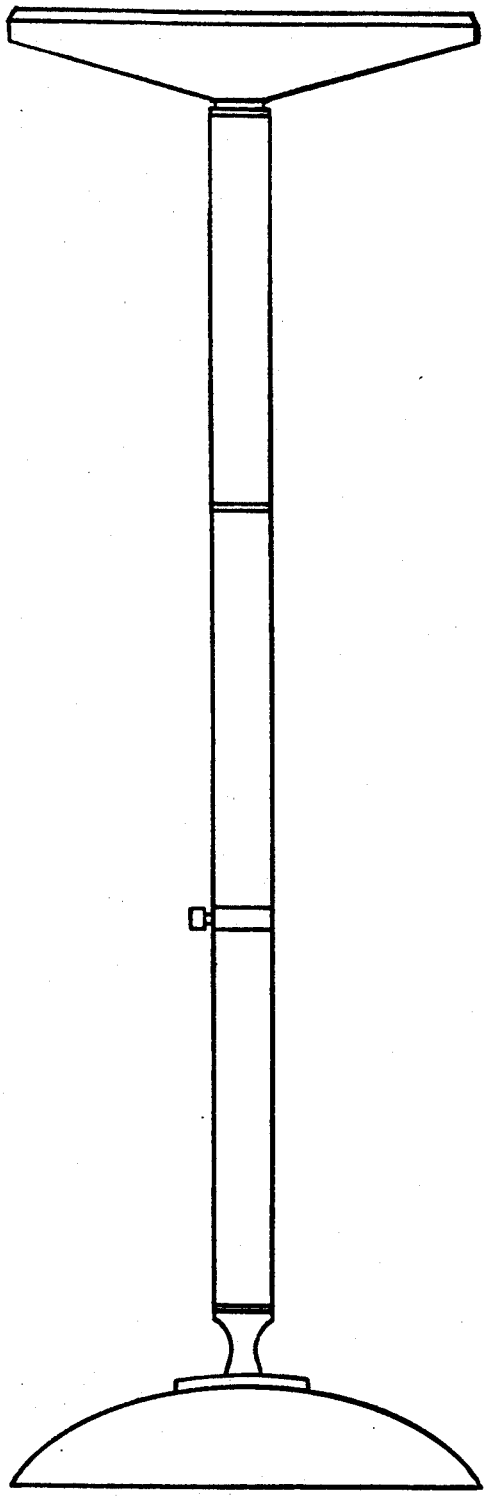
FIG. 4 illustrates a floor lamp embodying the present invention.

Referring to FIGS. 2 and 3, therein illustrated is the preferred embodiment of the floor lamp rotary dimmer switch mounting structure as constructed in accordance with the present invention which is generally comprises of a pipe connector 1, two tubes 2, and a rotary dimmer switch 3. The pipe connector 1 has two outer thread portions 11 on the outer wall thereof at two opposite ends, and an open-ended elongated slot 12 piercing through the outer wall and extending from either end edge thereof. The width of the elongated slot 12 is slightly larger than the outer diameter of the rotatable control shaft 31 of the rotary dimmer switch 3. The tubes 2 have each at least an inner thread portion 21 at one end for connecting the outer thread portions 11 of the pipe connector 1. During assembly, the rotary dimmer switch 3 is inserted through the pipe connector 1 with the rotatable control shaft 31 thereof projecting over the elongated slot 12 of the pipe connector 1, and then, the tubes 2 are respectively connected to the pipe connector 1 to receive the rotary dimmer switch 3 therein. Because the rotary dimmer switch 3 is not completely inserted inside either tube 2 and the pipe connector 1 has an elongated slot 12 for receiving the rotatable control shaft 31 of the rotary dimmer switch 3, the caliber of the tubes 2 can be greatly reduced. The tubes 2 are connected in series by the pipe connector 1, forming into a lamp support for a floor lamp (see FIG. 4). In the present preferred embodiment, the tubes 2 are connected to the pipe connector 1 through screw joint. As an alternate form of the present invention, the tubes 2 may be connected to the pipe connector 1 through any of a variety of known connecting methods. Further, two or more tubes may be connected in series by two or more pipe connectors to form into an extended size of lamp support for a floor lamp.

What is claimed is:

1. A mounting assembly for a rotary dimmer switch of a floor lamp comprising:

a) a hollow pipe connector having two opposite ends and an open-ended slot extending longitudinally along a wall of the connector from one end thereof;

b) a rotary dimmer switch including an outwardly extending rigid rotatable control shaft, the dimmer switch being disposed within the pipe connector and the control shaft extending outwardly from the slot, the control shaft and the dimmer switch having a combined overall height; and c) a pair of hollow tubes connected to the opposite ends of the pipe connector and the hollow tubes and the pipe connector each having a diameter that is less than the overall height of the control shaft and the dimmer switch.

* * * * *